United States Patent [19]

Ohyama et al.

[11] Patent Number: 4,745,335

[45] Date of Patent: May 17, 1988

[54] MAGNESIUM VAPOR DISCHARGE LAMP

[75] Inventors: Masachika Ohyama, Himeji; Mitsuo Narita, Takasago; Kunihiro Noguchi, Himeji, all of Japan

[73] Assignee: Ushio Denki Kabushiki Kaisha, Tokyo, Japan

[21] Appl. No.: 909,915

[22] Filed: Sep. 22, 1986

[30] Foreign Application Priority Data

Oct. 4, 1985 [JP] Japan ..... 60-220326
Dec. 23, 1985 [JP] Japan ..... 60-287991

[51] Int. Cl.[4] ..... H01J 61/12
[52] U.S. Cl. ..... 313/639; 313/642
[58] Field of Search ..... 313/639, 641, 642, 637, 313/570, 571

[56] References Cited

U.S. PATENT DOCUMENTS

| | | | |
|---|---|---|---|
| 3,319,119 | 5/1967 | Rendina | 313/572 X |
| 3,867,665 | 2/1975 | Furmidge et al. | 313/485 |
| 3,906,284 | 9/1975 | Franck et al. | 313/490 |
| 4,074,164 | 2/1978 | Leyendecker | 313/641 X |

*Primary Examiner*—David K. Moore
*Assistant Examiner*—Sandra L. O'Shea
*Attorney, Agent, or Firm*—Robert F. Ziems

[57] ABSTRACT

A magnesium vapor discharge lamp includes a light-emitting tubing in which magnesium and a halogen are sealed as light-emitting substances together with mercury and a rare gas in amounts sufficient to retain a discharge. Iron is additionally sealed within the light-emitting tubing.

7 Claims, 4 Drawing Sheets

MAGNESIUM VAPOR DISCHARGE LAMP

BACKGROUND OF THE INVENTION (1) Field of the Invention

This invention relates to magnesium vapor discharge lamps useful as ultraviolet ray sources in photochemical reactions.

(2) Description of the Prior Art

Discharge lamps permitting effective emission of ultraviolet rays having wavelengths in the range of about 250–400 nm are used to induce photochemical reactions. High-pressure mercury vapor lamps and super high-pressure mercury vapor lamps, in each of which a discharge is produced between its electrodes, have conventionally employed as such discharge lamps. Furthermore, electrodeless high-pressure mercury vapor lamps have also been known recently, in each of which mercury and a rare gas are sealed in amounts sufficient to retain a discharge within an electrodeless light-emitting tubing, and electromagnetic waves such as high-frequency waves of several tens MHz or higher or microwaves are externally irradiated to the tubing so as to excite the internally-sealed mixture and to produce a discharge as light.

By the way, each of these electrode-type or electrodeless high-pressure mercury vapor lamps emits light having a line spectrum which comprises a number of peaks and extends over a considerably wide wavelength range. It is therefore inefficient to use high-pressure mercury vapor lamps for photochemical reactions, which require the above-mentioned range as an effective wavelength range. Accordingly, there are often employed metal vapor discharge lamps in each of which a metal halide is sealed as a light-emitting substance within the light-emitting tubing so as to increase the light quantity of a specific effective wavelength range. Magnesium vapor discharge lamps containing magnesium sealed therein can additionally output bright lines of 279 nm, 285 nm, 309 nm, 383 nm and 384 nm besides the spectrum of mercury. They are hence expected to improve the efficiency in improving certain chemical reactions.

However, the output of each of the above-described bright lines which have been newly given off owing to the sealing of magnesium is small compared with the output of the bright lines of the spectrum of mercury. Under the circumstances, the output of ultraviolet rays having wavelengths in the range effective for photochemical reactions, which a magnesium vapor discharge lamp gives off, is not substantially different from that of a high-pressure mercury vapor discharge lamp.

SUMMARY OF THE INVENTION

An object of this invention is to provide a magnesium vapor discharge lamp capable of emitting a spectrum of sufficient intensity from the sealed magnesium and achieving a large output of ultraviolet rays having wavelengths in a range effective for photochemical reactions.

With a view toward attaining the above object of this invention, the present inventors found that an addition of iron to a metal vapor discharge lamp containing magnesium as a light-emitting substance is effective for increasing the intensity of the emission spectrum of magnesium. A variety of experiments has then been conducted on the basis of this finding, leading to completion of the present invention.

In one aspect of this invention, there is thus provided a magnesium vapor discharge lamp comprising a light-emitting tubing in which magnesium and a halogen are sealed as light-emitting substances together with mercury and a rare gas in amounts sufficient to retain a discharge. Iron is additionally sealed within the light-emitting tubing.

The term "tubing" as used herein should be interpreted in a broad sense provided that the object of this invention is attained. The term "tubing" may therefore embrace, for example, tubes, bulbs and the like.

Since iron is added to a metal vapor discharge lamp containing magnesium as a light-emitting substance in the present invention, the output of each emission spectrum of magnesium can be increased significantly. Therefore, the discharge lamp may be used as an ultraviolet ray discharge lamp suitable for chemical reactions for which a wavelength range of 250–400 nm is effective. As another merit, it is also possible to change the output level and shape of each spectrum, primarily, in the range of 350–400 nm by adjusting the amount of iron to be added, thereby making it possible to conform with characteristics of a photochemical reaction to which the magnesium vapor discharge lamp of this invention is applied.

BRIEF DESCRIPTION OF THE DRAWINGS

The above and other objects, features and advantages of the present invention will become apparent from the following description of the invention and appended claims, taken in conjunction with the appended drawings, in which:

DETAILED DESCRIPTION OF THE INVENTION AND PREFERRED EMBODIMENTS

The output of the emission spectrum of a magnesium vapor discharge lamp increases significantly by an addition of iron and moreover, it is only necessary to seal iron in an extremely small amount. It has been confirmed that an addition at a rate of $1\times10^{-8}$ mole per cc of the internal volume of the light-emitting tubing can bring about sufficiently large effects. Even if iron is added in a larger amount, no substantial adverse effects are observed to the emission spectrum of magnesium and on the contrary, the output of a continuous spectrum in the wavelength range of 350–400 nm increases owing to emission of additional light by an iron halogenide.

It is hence necessary to add more iron where a photochemical reaction requires the wavelength range of 350–400 nm. When a continuous spectrum is either unnecessary or inconvenient, it is recommended to add less iron so as to increase the emission spectrum of magnesium only. When a photochemical reaction requires a short wavelength range of 270–300 nm on the other hand, iron may be added in any desired amount because the continuous spectrum of iron in this range is extremely weak. For such a photochemical reaction, the output of the spectrum of mercury and the outputs of peaks of 279 nm and 285 nm of increased magnesium can be used. Namely, iron may be added in any amount as desired in accordance with the type of each photochemical reaction to which the magnesium vapor discharge lamp of this invention is applied.

[EXAMPLES]

The embodiments of this invention will hereinafter be described specifically.

Figure 1:
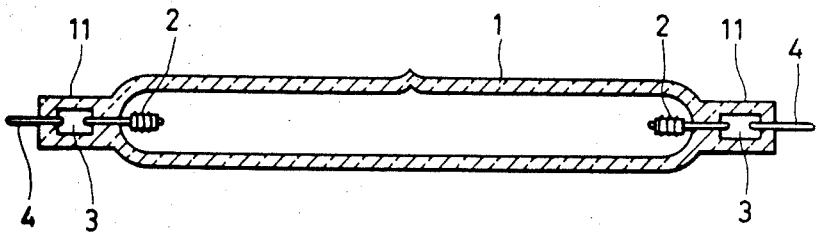
FIG. 1 is a longitudinal cross-section of an electrode-type magnesium vapor discharge lamp according to one embodiment of this invention.

Referring first to FIG. 1, the rated power consumption of the magnesium vapor discharge lamp is 4 KW. It is useful as a light source for photochemical reactions. A pair of electrodes 2,2 are disposed in an opposing relation within a light-emitting tube 1 which comprises a fused silica tube having an inner diameter of 22 mm and an internal volume of 100 cc. The electrode interval is 250 mm. Sealed bases 11 are provided at both ends of the light-emitting tube 1. Within each of the sealed bases 11, there is sealed a molybdenum foil 3 via which an outer lead 4 is electrically connected to its associated electrode 2.

Figure 4:
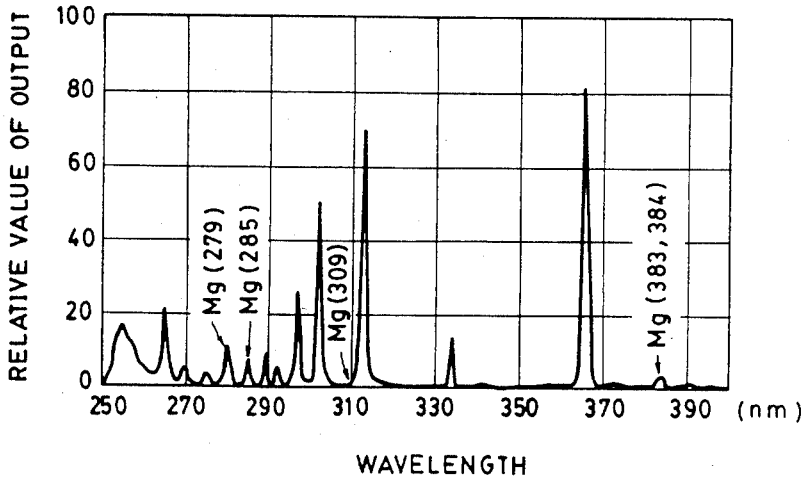
FIG. 4 is an emission spectrum of an electrode-type magnesium vapor discharge lamp as a control, which was the same as that in FIG. 1 except for the omission of iron.
Figure 2:
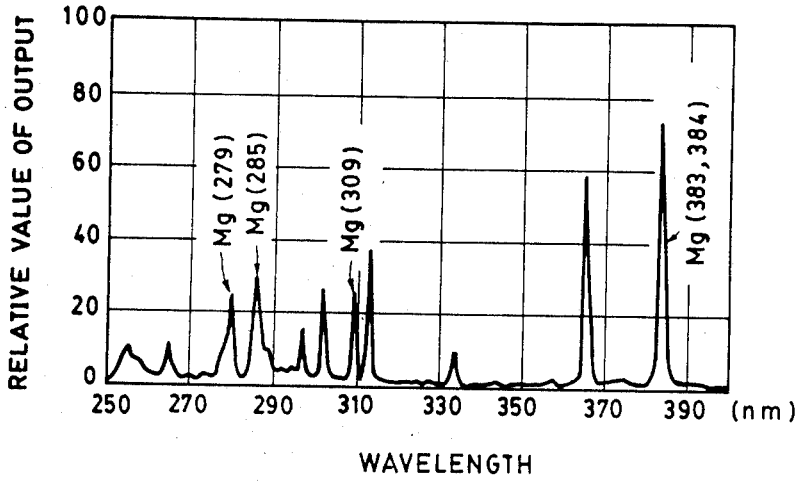
FIG. 2 and FIG. 3 are emission spectra of the discharge lamp FIG. 1, within which iron was sealed in different amounts.
Figure 3:
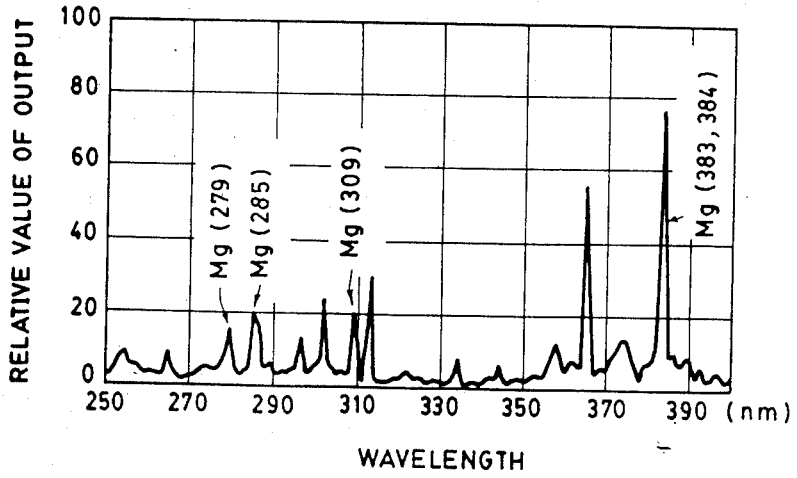

Sealed within the light-emitting tube 1 are 170 mg of mercury, $1\times10^{-5}$ mole of magnesium iodide and 15 mmHg of argon gas. As a first example, $1\times10^{-6}$ mole of iron iodide was sealed further. Another magnesium vapor discharge lamp was also fabricated as a second example by changing the amount of sealed iron iodide to $30\times10^{-6}$ mole. As a control, a further magnesium vapor discharge lamp was also fabricated without iron iodide. Namely, 3 discharge lamps of different types were fabricated in total. They were lit at an electricity input of 4 KW and the distribution of their emission spectra were measured. Results are shown in in FIGS. 2–4, which correspond to the first example, second example and control respectively.

As is understood from these drawings, the peaks of the emission spectrum of magnesium were each increased significantly, compared with the control in which no iron was added, in the first example in which $1\times10^{-6}$ of iron iodide was added. The significance of addition of iron is thus observed. In the second example in which the amount of added iron iodide was increased to $30\times10^{-6}$ mole, the emission spectrum of magnesium tended to decrease compared with the first example in which iron iodide was added in the smaller amount but increased significantly compared with the control in which iron iodide was not added. In addition, the emission spectrum of iron is observed to appear as a continuous spectrum over the wavelength range of 350–400 nm.

It has hence been confirmed that the intensity of the emission spectrum of magnesium can be increased considerably by adding a small amount of iron and a continuous spectrum of iron appears as the amount of iron is increased further. It is therefore possible to provide a magnesium vapor discharge lamp, that is, an ultraviolet ray discharge lamp most suitable for each photochemical reaction by adjusting the amount of iron to be added in accordance with the specific wavelength range which the photochemical reaction requires and depending whether the photochemical reaction requires bright lines or a continuous spectrum.

Further, the addition of iron does not give any substantial effects to electrical characteristics such as starting voltage and restriking voltage.

Figure 5:
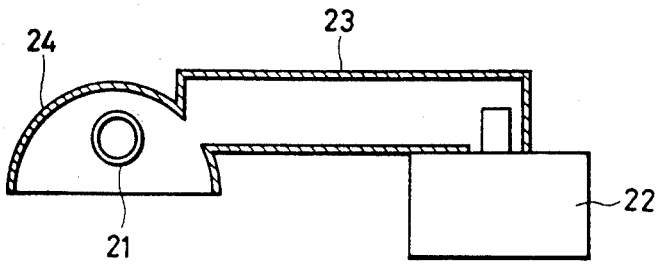
FIG. 5 is a schematic cross-sectional view of a light source unit for photochemical reactions, in which an electrodeless magnesium vapor discharge lamp according to another embodiment of this invention is incorporated.

Referring next to FIG. 5, the rated output of a magnetron 22 is 1.5 KW. The magnetron 22 generates microwaves having a wavelength of 2,450 MHz. These microwaves are guided into a reflector 24 through a waveguide 23. Within the reflector 24, the electrodeless magnesium vapor discharge lamp, that is, ultraviolet ray discharge lamp constructed of a spherical light-emitting bulb 21 made of silica glass is disposed. Microwaves are irradiated to the light-emitting bulb 21. The frequency of microwaves is not limited to the above-mentioned frequency. Any high frequencies of several tens MHz and higher may be successfully employed.

The inner diameter of the light-emitting bulb 21 is 22 mm and its internal volume is about 5.6 cc. Within the light-emitting bulb 21, are sealed 6 mg of metal mercury, $1.6\times10^{-6}$ mole of magnesium iodide and 10 mmHg of argon. Further, iron iodide is additionally incorporated. Three electrodeless discharge lamps of different types were fabricated in total, including a first example containing $1.6\times10^{-7}$ mole of iron iodide, a second example containing $4.8\times10^{-6}$ mole of iron iodide and a control containing no iron iodide.

Figure 8:
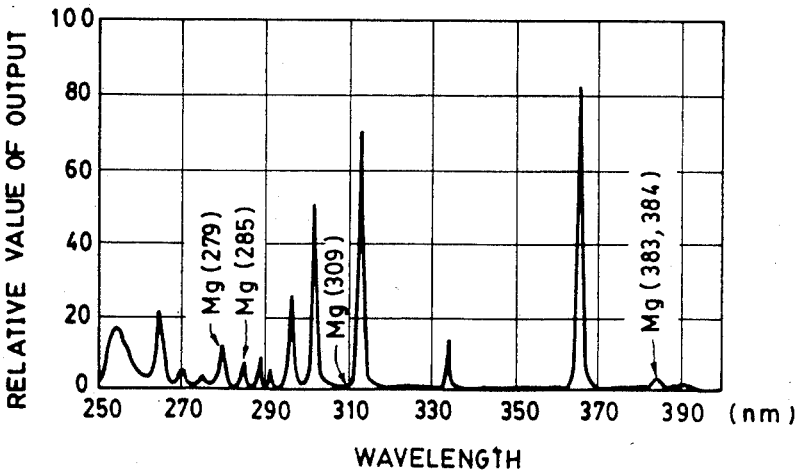
FIG. 8 is an emission spectrum of an electrodeless magnesium vapor discharge lamp as a control, which was the same as that in FIG. 5 except for the omission of iron.
Figure 6:
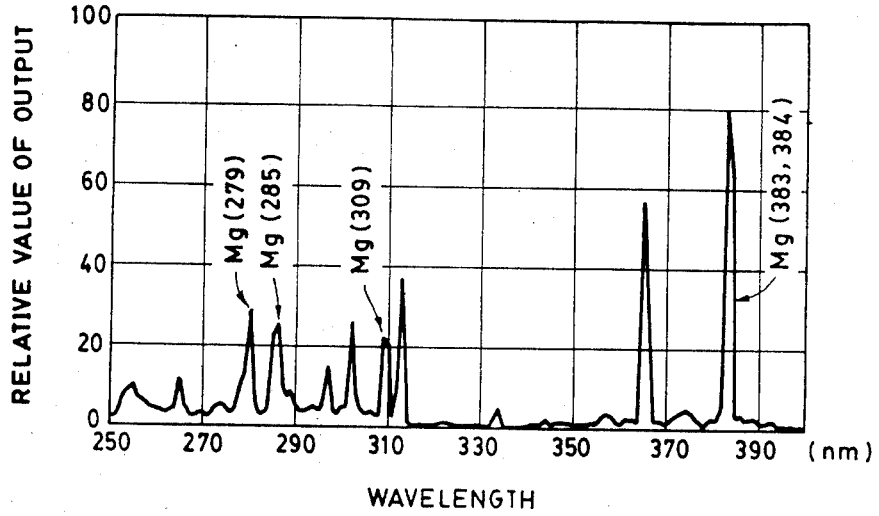
FIG. 6 and FIG. 7 are emission spectra of the discharge lamp FIG. 5, within which iron was sealed in different amounts.
Figure 7:
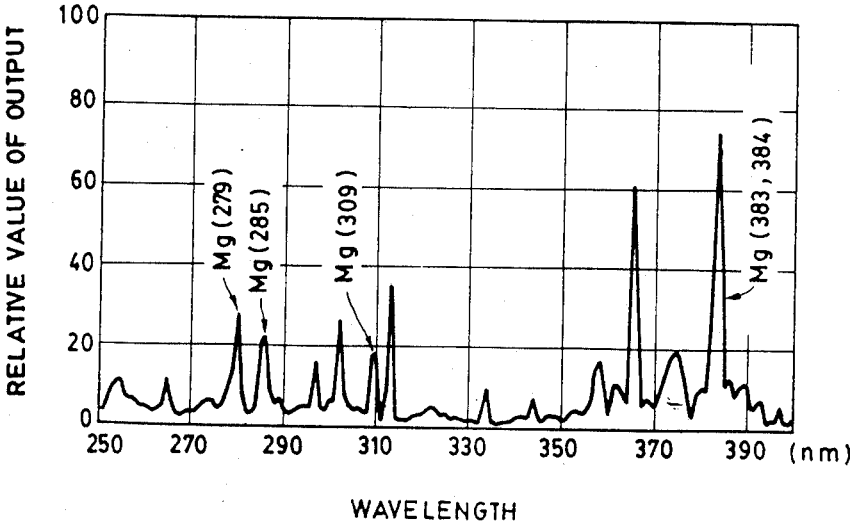

When microwaves were irradiated to the light-emitting bulb 21, the mixture sealed within the bulb 21 was excited to produce a discharge, thereby being lit. The distribution of emission spectra of the three types of electrodeless discharge lamps were measured. Results are shown respectively in FIGS. 6–8, which corresponding respectively to the first and second examples and the control.

As is understood from these drawings, the peaks of the emission spectrum of magnesium were each increased significantly, compared with the control in which no iron was added, in the first example in which $1.6\times10^{-7}$ of iron iodide was added. The significance of addition of iron is thus observed. In the second example in which the amount of added iron iodide was increased to $4.8\times10^{-6}$ mole, the peaks of the emission spectrum of magnesium tended to decrease to some extents compared with the first example in which iron iodide was added in the smaller amount but increased significantly compared with the control in which iron iodide was not added. In addition, the emission spectrum of iron is observed to appear as a continuous spectrum over the wavelength range of 350–400 nm. As demonstrated above, a spectrum similar to that obtained from an electrode-type discharge lamp can also be obtained by an electrodeless discharge lamp.

Having now fully described the invention, it will be apparent to one of ordinary skill in the art that many changes and modifications can be made thereto without departing from the spirit or scope of the invention as set forth herein.

We claim:

1. In a magnesium vapor discharge lamp including a light-emitting tubing in which magnesium and a halogen are sealed as light-emitting substances together with mercury and a rare gas in amounts sufficient to retain a discharge, the improvement comprising: iron additionally sealed within the light-emitting tubing in order to intensify the emission spectrum of magnesium.

2. The discharge lamp as claimed in claim 1, wherein the light-emitting tubing is equipped with discharge electrodes for producing an arc discharge.

3. The discharge lamp as claimed in claim 1, wherein the discharge lamp is an electrodeless discharge lamp of such type that electromagnetic waves are externally irradiated to the light-emitting tubing, whereby the mixture of the magnesium, halogen, mercury, rare gas and iron sealed within the light-emitting tubing is excited to give off a discharge as light.

4. The magnesium vapor discharge lamp of claim 1, wherein the magnesium is magnesium iodide and the added iron is iron iodide.

5. The magnesium vapor discharge lamp of claim 4, wherein said rare gas is one selected from the group consisting of argon gas and xenon gas.

6. A mehtod of controlling the intensity of the emitted spectrum of light from a magnesium vapor discharge lamp, comprising the steps of:

providing the lamp with a fill including magnesium and a halogen together with mercury and a rare gas; and, adding iron to the fill in a quantity sufficient to increase the intensity peaks of the emission spectrum of magnesium.

7. The method of claim 6, further comprising the step of:

adding more iron to the magnesium lamp fill in an amount sufficient to cause a continuous emission spectrum over the wavelength range of approximately 350–400 nm.

* * * * *